US005651208A

United States Patent [19]

Benson

[11] Patent Number: 5,651,208

[45] Date of Patent: Jul. 29, 1997

[54] CARTRIDGE CASTING COLLECTOR

[76] Inventor: Phillip Dean Benson, 644 Victoria Way, Arroyo Grande, Calif. 93420

[21] Appl. No.: 510,702

[22] Filed: Aug. 3, 1995

[51] Int. Cl.[6] ..... F41A 15/00

[52] U.S. Cl. ..... 42/98; 42/25; 42/90; 42/106

[58] Field of Search ..... 42/98, 25, 90, 42/106; 89/33.4

[56] References Cited

U.S. PATENT DOCUMENTS

| | | | |
|---|---|---|---|
| 3,153,981 | 10/1964 | Brass | 42/98 |
| 3,390,610 | 7/1968 | Jordan | 89/33 |
| 3,628,277 | 12/1971 | Plumer | 42/25 |
| 3,739,685 | 6/1973 | Lundgren | 89/33 F |
| 4,020,738 | 5/1977 | Martinez | 89/33 F |
| 4,028,834 | 6/1977 | Dobson | 42/1 T |
| 4,166,333 | 9/1979 | Kratzer | 42/1 T |
| 4,204,353 | 5/1980 | Isda | 42/1 T |
| 4,334,375 | 6/1982 | Olson | 42/1 T |
| 4,903,426 | 2/1990 | Bammate | 42/98 |
| 5,398,439 | 3/1995 | Harless | 42/98 |

*Primary Examiner*—Charles T. Jordan
*Assistant Examiner*—Meena Chelliah
*Attorney, Agent, or Firm*—Joseph N. Breaux

[57] ABSTRACT

A cartridge casing collector, for use with rifles of the type having a cartridge casing ejection port in connection with the exterior of the rifle, including a housing member having a collecting chamber formed therein in communication with a casing receiving aperture, and a spring loaded gripping assembly secured to the housing assembly for securing the casing receiving aperture over the ejection port of a rifle in a manner such that cartridge casings ejected from the ejection port are directed through the cartridge casing receiving aperture and into the collecting chamber. The collecting chamber is at least partially defined by an interior surface having a radius of curvature between three and one-eight (3-⅛") and five and one-half (5-½") inches and a length corresponding to an arc of at least thirty (30°) degrees of the radius of curvature.

7 Claims, 7 Drawing Sheets

CARTRIDGE CASTING COLLECTOR

TECHNICAL FIELD

The present invention relates to devices for capturing and storing the ejected cartridge casings from a rifle and more particularly to cartridge casing collectors used for capturing and storing the ejected cartridge casings from rifles that may be emptied without removing any portion of the collector from the rifle.

BACKGROUND ART

Most rifles eject cartridge casings from an ejection port prior to insertion of another cartridge within the firing chamber. This ejection can be manually accomplished through a bolt action or automatically accomplished through a gas operated ejection mechanism. Once ejected from the ejection port, cartridge casings can strike people in the area as they fly through the air or cause people to slip as they accumulate on the ground. It would be a benefit, therefore, to have a collector securable to the rifle that captured and held the ejected cartridge casings as they were ejected from the ejector port. It would be a further benefit, if the cartridge casing collector could be easily and rapidly emptied without removing the collector from the rifle to which it is attached.

In addition, because the cartridge casings are made of non-magnetic brass alloy, it would be a benefit if the casing collector had an extraction door magnetically securable in a closed position. This would allow for positive closure of the casing collector without the need for sharp, breakable closure hooks and fittings.

It is also a problem to quickly secure the receiving aperture of the collector over the ejector port of the rifle. It would be a benefit, therefore, to have a cartridge casing collector that was quickly securable to a rifle with a positive gripping force using a clamp assembly including an adjustable tensioning mechanism. It would be a further benefit, if the cartridge casing collector provided access paths to the various functional levers and buttons of the rifle, including the clip release button of the rifle, while it is secured to the rifle.

GENERAL SUMMARY DISCUSSION OF INVENTION

It is thus an object of the invention to provide a cartridge casing collector that may be emptied without removing any portion of the collector from the rifle to which it is attached.

It is a further object of the invention to provide a cartridge casing collector that may be emptied without removing any portion of the collector from the rifle to which it is attached via a securable casing extraction door.

It is a still further object of the invention to provide a cartridge casing collector that is securable to a rifle with a clamp assembly including an adjustable tensioning mechanism.

It is a still further object of the invention to provide a cartridge casing collector that provides access to the magazine clip release button of the rifle while secured to the rifle.

It is a still further object of the invention to provide a cartridge casing collector that achieves all or some of the above described objects in combination.

Accordingly, a cartridge casing collector is provided for use with rifles of the type having a cartridge casing ejection port in connection with the exterior of the rifle. The cartridge casing collector includes a housing member having a collecting chamber formed therein in communication with a casing receiving aperture, and a spring loaded gripping assembly secured to the housing assembly for securing the casing receiving aperture over the ejection port of a rifle in a manner such that cartridge casings ejected from the ejection port are directed through the cartridge casing receiving aperture and into the collecting chamber. The collecting chamber is at least partially defined by an interior surface having a radius of curvature between three and one-eight (3-⅛") and five and one-half (5-½") inches and a length corresponding to an arc of at least thirty (30°) degrees of the radius of curvature.

In a preferred embodiment, the housing member includes a first housing section having a second aperture in addition to the casing receiving aperture, and a second housing section, hingedly secured to the second housing section in a manner such that the second housing member blocks the passage of cartridge casings through the second aperture when in a first predetermined position and is moveable into a second predetermined position such that cartridge casings may pass through the second aperture. The second housing member is preferably held in the first predetermined position via magnetic attraction between portions of the first and second housing sections, and, more preferably, held in place by the magnetic attraction between a first and second magnet secured to the first and second housing sections respectively.

A portion of the outer surface of the housing member that is adjacent the outer surface of the rifle during use is defined by a radius of between three-quarters (¾") and two and one-half (2-½") inches moved through an arc sufficient to provided an access gap between the outer surface of the rifle and the housing member sufficient to allow the thumb of a user to be disposed therebetween, and, more preferably, an arc of at least twenty (20°) degrees.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
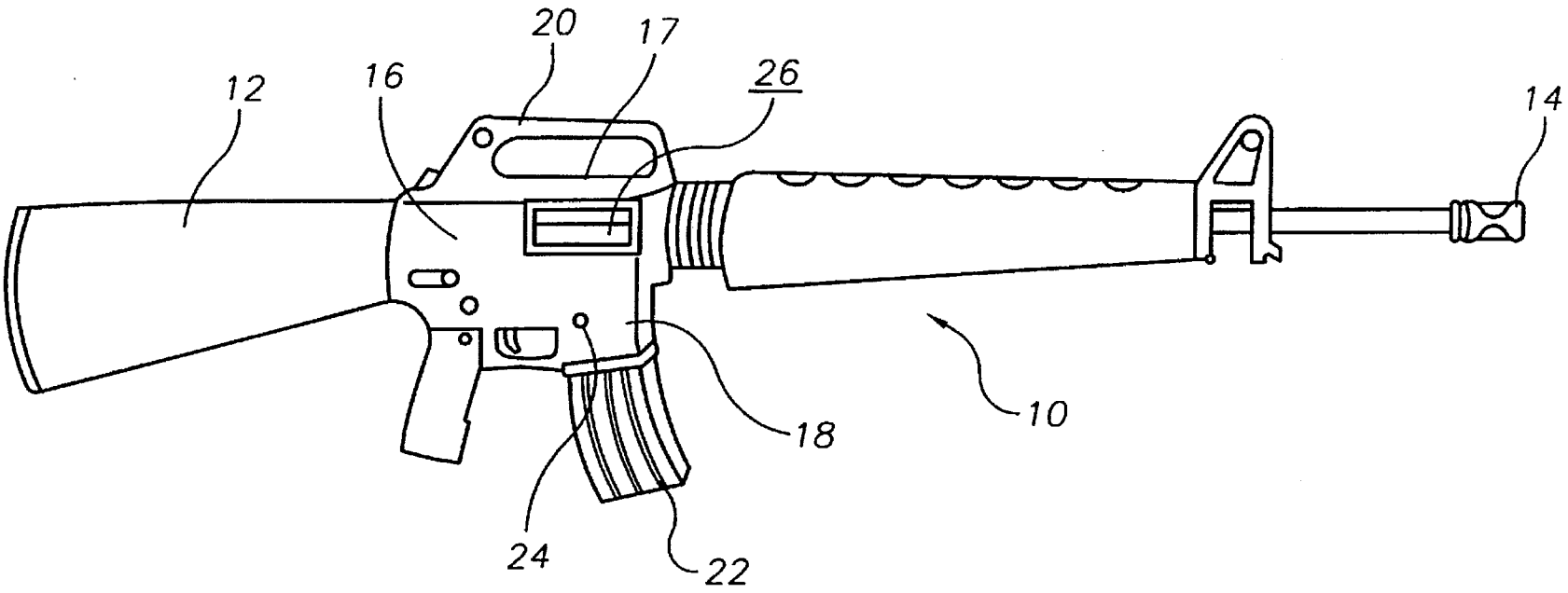
FIG. 1 is a side view of a representative rifle of the type with which the cartridge casing collector of the present invention may be utilized.

FIG. 1 is a side view of an M-16 rifle, generally referenced by the numeral 10, that is representative of the type of rifle with which the cartridge casing collector of the present invention is utilized. Rifle 10 includes a stock 12, a muzzle 14, a upper receiver 16 having a receiver top 17, a lower receiver 18, a carrying handle 20, a cartridge magazine clip 22, a magazine clip release button 24, and an ejection port 26 through which cartridge casings are ejected after the cartridge has been fired.

Figure 2:
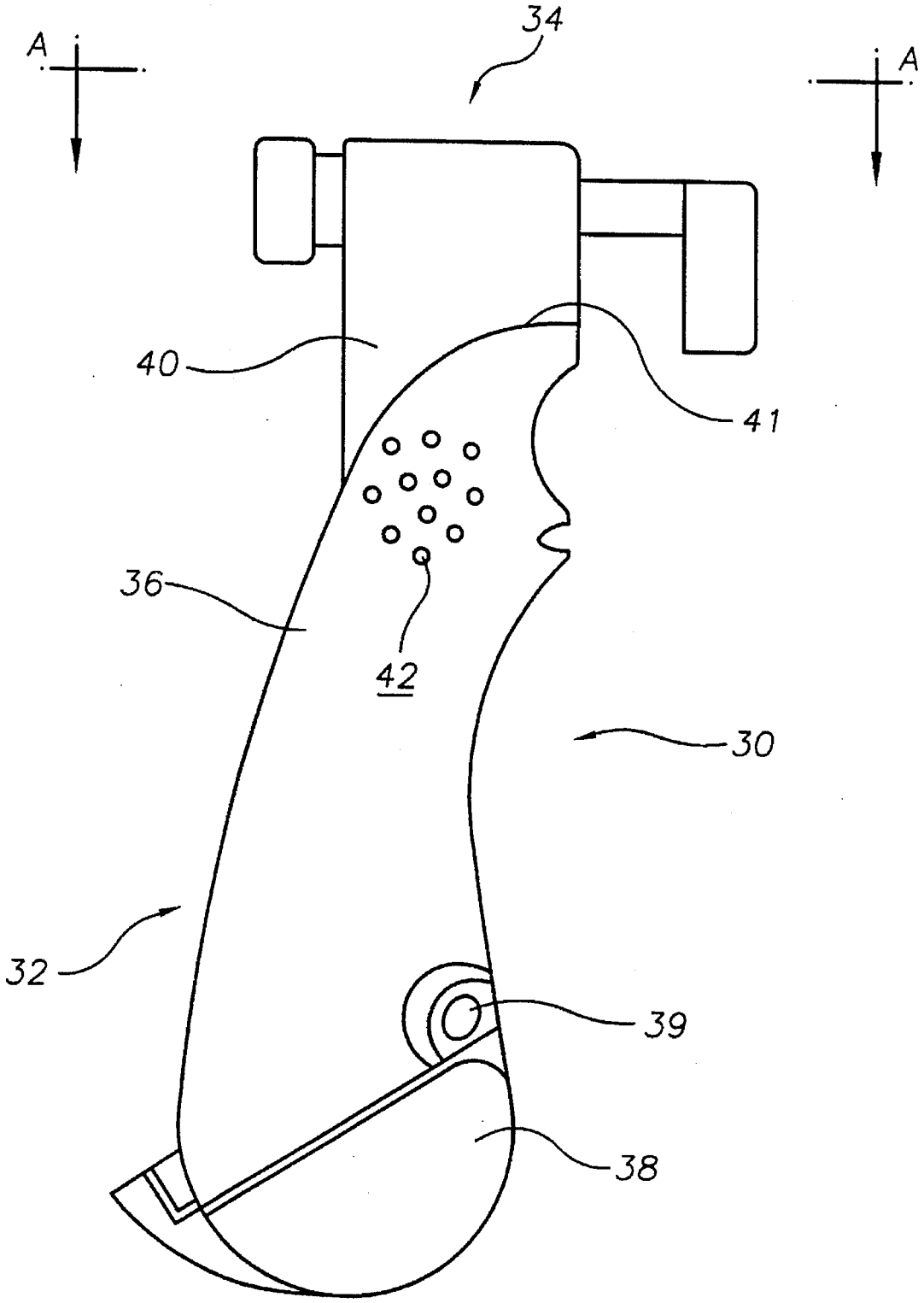
FIG. 2 is a side view of an exemplary embodiment of the cartridge casing collector of the present invention showing the muzzle facing side including a grouping gas venting holes.

FIG. 2 is a front, muzzle facing, side view of an exemplary embodiment of the cartridge casing collector, generally referenced by the numeral 30. Collector 30 includes a housing member, generally referenced by the numeral 32, and a gripping assembly generally referenced by the numeral 34. Housing member 30 includes a first housing section 36; a second housing section 38, hingedly connected to first housing section 36 with a hinge 39; and a gripping assembly mount 40, integrally formed at the top portion 41 of first housing section 36. As shown in the figure, first housing section 36 includes a plurality of gas venting apertures 42 through the outer surface thereof in gas transmitting communication with a collecting chamber formed within and by first and second housing sections 36,38.

Figure 3:
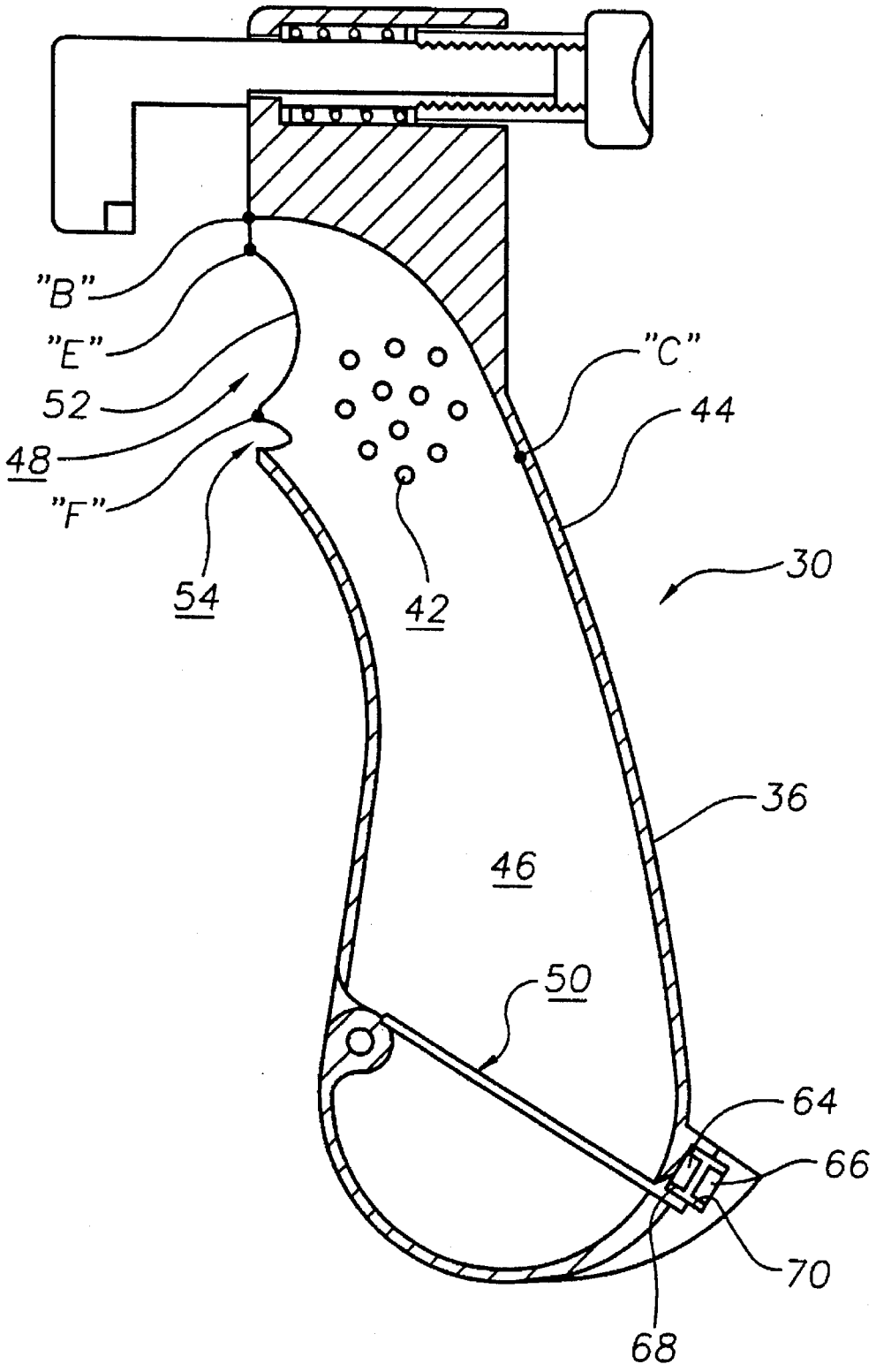
FIG. 3 is a cross-sectional view of the cartridge casing collector of FIG. 2 showing the clamp assembly in the fully retracted position and the lower casing extraction door in the closed position.

FIG. 3 is a cross-sectional view of collector 30 along the line A—A. The figure shows a first wall 44 that partially defines a collecting chamber 46. First wall 44 has a radius of curvature between points "B" and "C" of four and one-eighth (4-⅛") inches over a length corresponding to about a sixty (60°) degree sweep of the radius.

As described herein before, collecting chamber 46 is in gas transmitting communication with the outer surface of first housing section 36 through gas venting apertures 42. First housing section 36 also includes a casing receiving aperture, generally referenced by the numeral 48, and a casing removal aperture, generally referenced by the numeral 50.

Casing receiving aperture 48 has an arcuate profile between the points "E" and "F" defined by a radius of about five-eighths (⅝") of an inch to allow the perimeter 52 of casing receiving aperture 48 to contact and rest against the outer surface of upper receiver 16 and lower receiver 18 adjacent ejection port 26 when collector 30 is in use. In addition, a notch 54 is provided adjacent point "F" to allow collector 30 to rest flush against lower receiver 18.

Figure 4:
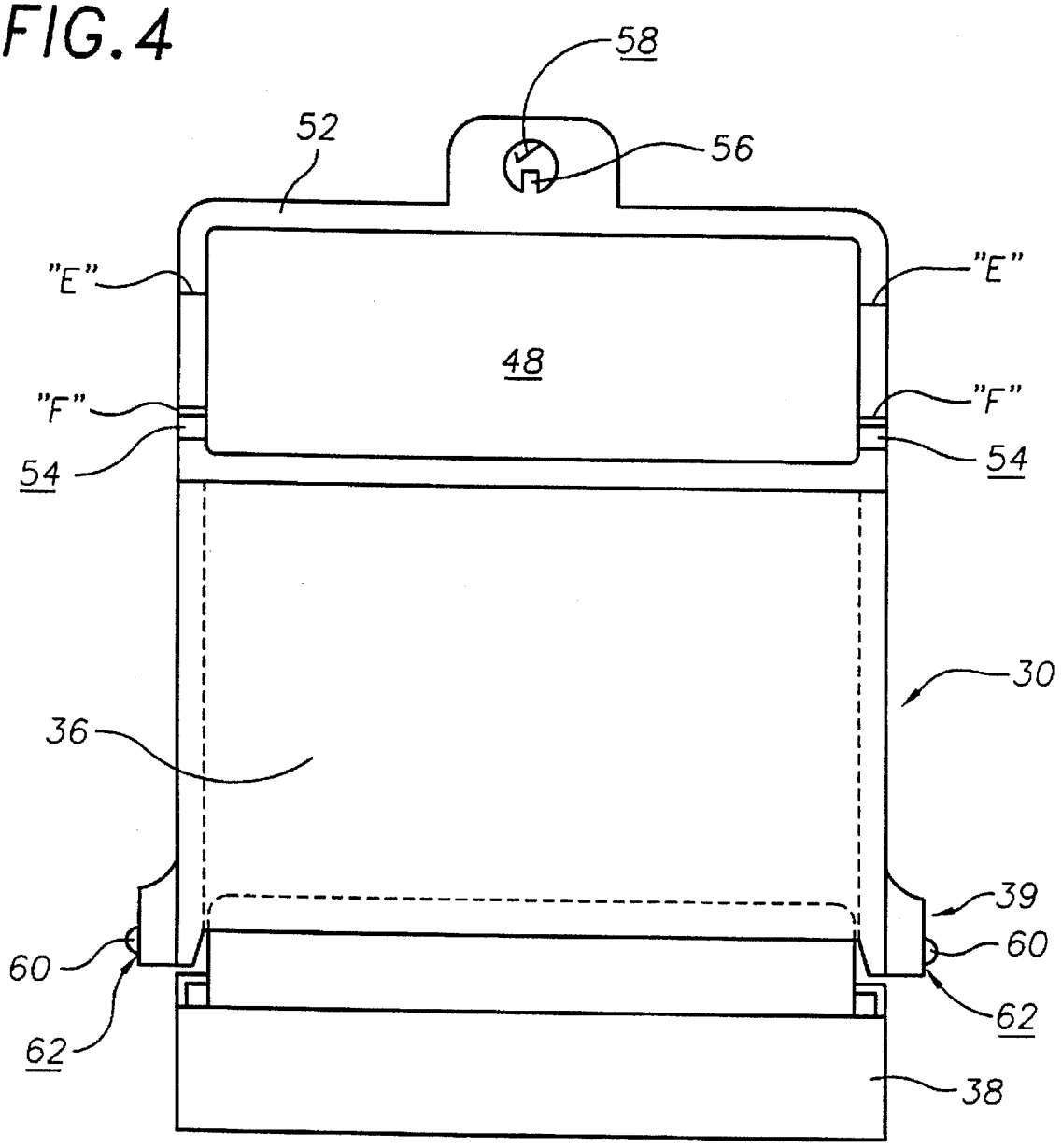
FIG. 4 is a side view of the exemplary embodiment of the cartridge casing collector of FIG. 2 showing the rifle facing side with the receiver clamp removed showing the guide tab extending into the clamp guide bore.

FIG. 4 is a side view of collector 30 showing casing receiving aperture 48 as it appears from the rifle with gripping assembly 34 removed for clarity. The entire perimeter 52 of receiving aperture 48 is shown including both points "E", both points "F", and both notches 54. Also shown in the figure is a guide tab 56 that extends into a clamp guide bore, generally referenced by the numeral 58.

FIG. 4 also shows second housing section 38 pivotally connected to first housing section 36 with a hinge 39 that includes two connecting pins 60 that pass through two hinge apertures 62 and are secured within second housing section 38.

Figure 5:
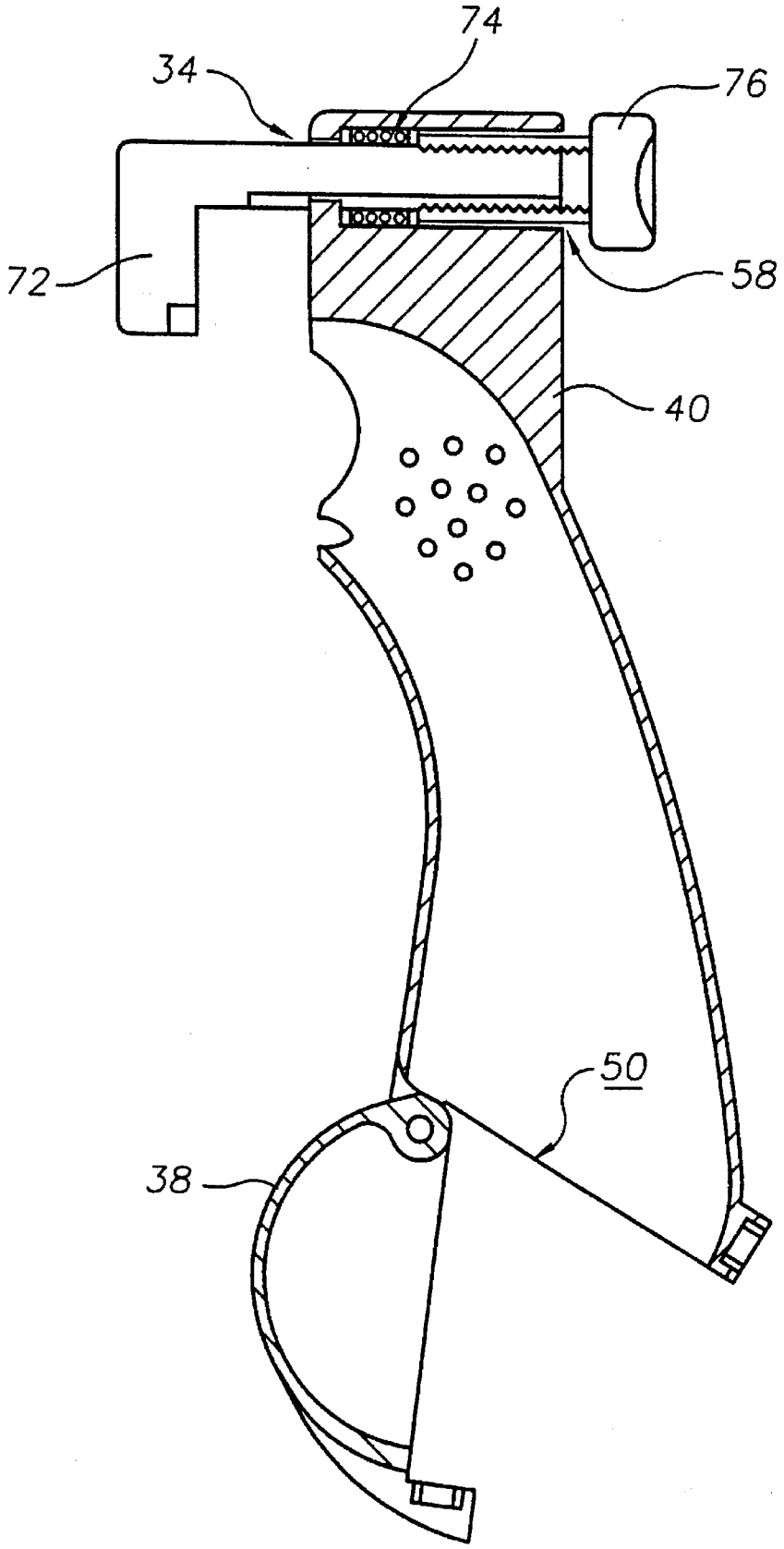
FIG. 5 is a cross-sectional view of the cartridge casing collector of FIG. 2 showing the clamp assembly in the fully extended position and the lower casing extraction door in the open position.

With reference once again to FIG. 3, second housing section 38 is held in a closed position by the magnetic attraction between first magnet 64 and second magnet 66 which are respectively each secured within a magnet holding cavity 68,70. Magnet holding cavities 68,70 are located such that they are adjacent each other when second housing section 38 is disposed across and blocking second aperture 50. In this embodiment magnets 64,66 are each one (1") inch long, by one-half (½") inch wide, by one-eight (⅛") inch thick, iron magnets. Although shown slightly separated in the figure for clarity it is preferred that magnets 64,66 contact each other when second housing section is in the fully closed position. FIG. 5 shows second housing section 38 pivoted out of position blocking second aperture 50.

Figure 6E:
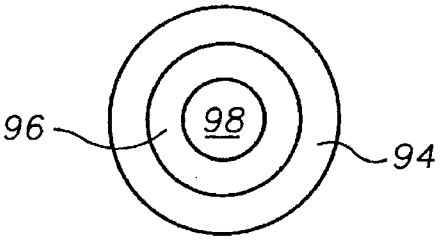
FIG. 6E is an end view of the tension adjustment member.
Figure 6D:
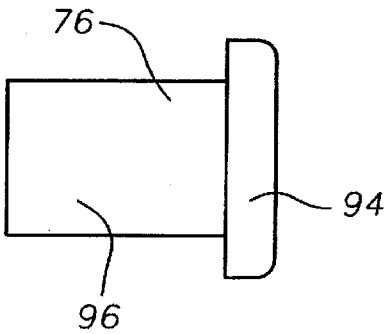
FIG. 6D is a side view of the tension adjustment member of the clamp assembly of the cartridge casing collector of FIG. 2.

With continued reference to FIG. 5, gripping assembly 34 includes gripping assembly mount 40, having a clamp guide bore 58; a clamp bracket 72; a spring assembly, generally referenced by the numeral 74; and a tension adjusting member 76. FIG. 6A is an underside view of clamp bracket 72 showing clamp member 78 including a recessed portion 80 and a rod member 82. Rod member 82 includes a threaded end 84 and a guide channel 86 formed along the length thereof. Guide channel 86 is sized to slidingly receive guide tab 56 in use. FIG. 6B is an end view of rod member 82 showing the depth of guide channel 86.

Figure 6C:
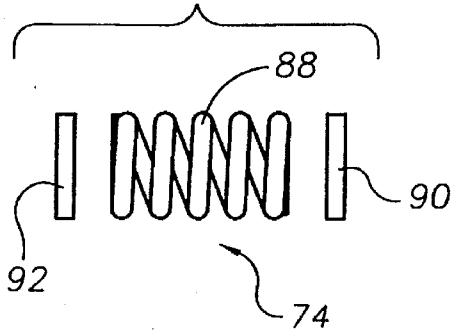
FIG. 6C is a side view of the spring assembly of the cartridge casing collector of FIG. 2.
Figure 6B:
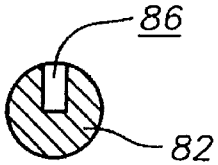
FIG. 6B is an end view of the rod member of the clamp bracket showing the guide channel within which the guide tab is disposed when the clamp assembly is assembled.
Figure 6A:
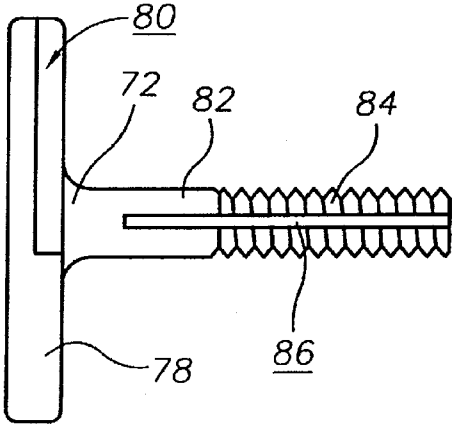
FIG. 6A is a side view of the clamp bracket of the gripping assembly of the cartridge casing collector of FIG. 2.

FIG. 6C shows spring assembly 74 including a spring 88 and a pair of washers 90,92. The apertures through spring 88 and washers 90,92 are sized to receive therethrough rod member 82.

FIG. 6D is a side view of tension adjusting member 76 showing a knob portion 94 and a clamp guide 96. Knob portion 94 may be grasped and rotated by a user to adjust the tension of clamp member 78 against rifle 10 during use. As shown in FIG. 6E knob portion 94 extends outwardly from clamp guide 96 and clamp guide 96 includes a threaded internal bore 98. The outer diameter of clamp guide 96 is selected to allow clamp guide 96 to slidingly fit within clamp guide bore 58.

Figure 7:
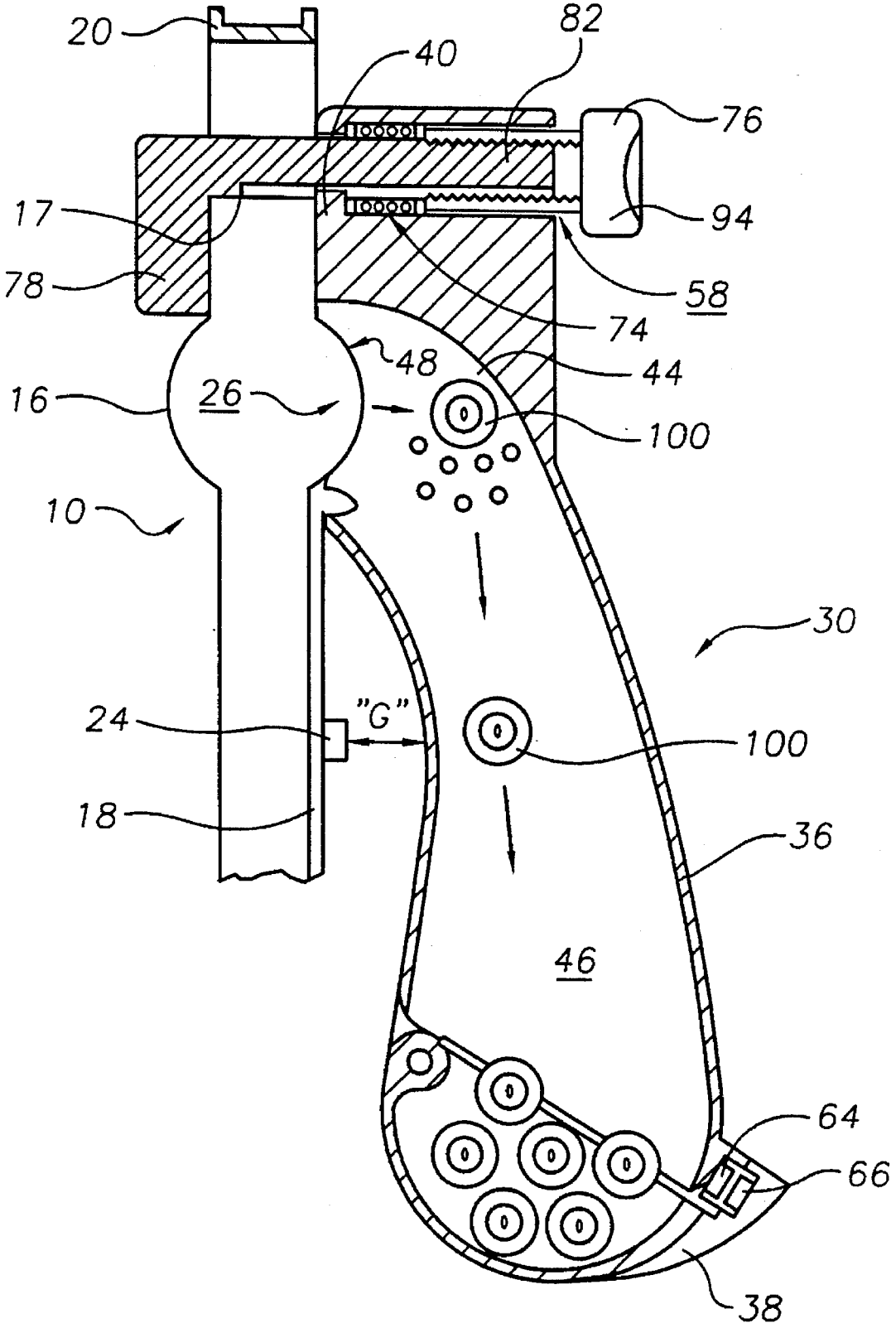
FIG. 7 is a cross-sectional view of the cartridge casing collector of FIG. 2 in connection with representative rifle of FIG. 1 showing the path traveled by casing after being ejected from the ejection port of the rifle.

FIG. 7 is a cross-sectional view of collector 30 in connection with representative rifle 10 including upper receiver 16, receiver top 17, lower receiver 18, carrying handle 20, magazine clip release button 24, and ejection port 26. Collector 30 is attached to rifle to by forcing tension adjusting member 76 into clamp guide bore 58 a sufficient distance to allow receiver top 17 to be positioned entirely between clamp bracket 78 and clamp guide bore mount 40. Once receiver top 17 is in position and receiving aperture 48 is in alignment over ejection port 26, the force against tension adjusting member 76 is released allowing spring assembly 74 to force clamp bracket 78 toward clamp guide bore mount 40 and thereby grip receiver top 17 and upper receiver 16 with sufficient force to secure collector 30 to rifle 10.

In use, cartridge casings 100 are ejected through ejection port 26, past casing receiving aperture 48 and into collecting chamber 46. Once in collecting chamber 46, cartridge casings 100 collide with interior wall 44 and are directed downward toward second housing section 38. Collecting chamber 46 may be emptied at any time by forcing second housing section 38 away from first housing section 36 with sufficient force to separate magnets 64,66. The tension supplied by spring assembly 74 is adjustable by rotating knob portion 94 of tension adjusting member 76. Rotating tension adjustment member 76 in the clockwise direction increases the tension supplied by spring assembly 74. Rotating tension adjustment member 76 in the counter-clockwise direction decreases the tension supplied by spring assembly 74. In addition, a gap "G" of sufficient size to allow the thumb of a user to access magazine clip release button 24 without removing collector 30.

It can be seen from the preceding description that a cartridge casing collector has been provided that may be emptied without removing any portion of the collector from the rifle to which it is attached; that includes a magnetically securable casing extraction door; that is securable to a rifle with a clamp assembly including an adjustable tensioning mechanism; and that provides access to the clip release button of the rifle while secured to the rifle.

It is noted that the embodiment of the cartridge casing collector described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A cartridge casing collector for use with rifles of the type having a cartridge casing ejection port in connection with the exterior of the rifle, said cartridge casing collector comprising:

a housing member having a collecting chamber formed therein in communication with a casing receiving aperture, said housing member including a first housing section having a second aperture, and a second housing section, hingedly secured to said first housing section in a manner such that said second housing section blocks passage of cartridge casings through said second aperture when in a first predetermined position and is moveable into a second predetermined position such that cartridge casings may pass through said second aperture; and a spring loaded gripping assembly, secured to said housing member, for securing said casing receiving aperture over said ejection port of said rifle in a manner such that cartridge casings ejected from said ejection port are directed through said cartridge casing receiving aperture and into said collecting chamber;

said collecting chamber being at least partially defined by an interior surface having a radius of curvature between three and one-eight (3-⅛") and five and one-half (5-½") inches and a length corresponding to an arc of at least thirty (30°) degrees of said radius of curvature;

said second housing member being held in said first predetermined position via magnetic attraction between a first portion of said first housing section and a second portion of said second housing section.

2. The cartridge casing collector of claim 1 wherein:

said first portion of said first housing section is a magnet; and said second portion of said second housing section is a magnet.

3. A cartridge casing collector for use with rifles of the type having a cartridge casing ejection port in connection with the exterior of the rifle, said cartridge casing collector comprising:

a housing member having a collecting chamber formed therein in communication with a casing receiving aperture, said housing member including a first housing section having a second aperture, and a second housing section, hingedly secured to said first housing section in a manner such that said second housing section blocks passage of cartridge casings through said second aperture when in a first predetermined position and is moveable into a second predetermined position such that cartridge casings may pass through said second aperture; and a spring loaded gripping assembly, secured to said housing member, for securing said casing receiving aperture over said ejection port of said rifle in a manner such that cartridge casings ejected from said ejection port are directed through said cartridge casing receiving aperture and into said collecting chamber;

said collecting chamber being at least partially defined by an interior surface having a radius of curvature between three and one-eight (3-⅛") and five and one-half (5-½") inches and a length corresponding to an arc of at least thirty (30°) degrees of said radius of curvature;

said housing member further including a gripping assembly mount, integrally formed at a top portion of said first housing section, having a clamp guide bore formed therethrough.

4. The cartridge casing collector of claim 2, wherein:

said first housing section includes a first magnet holding cavity, said second housing section includes a second magnet holding cavity; and said first and second magnet holding cavities are located such that they are adjacent each other when said second housing section is blocking said second aperture.

5. A cartridge casing collector for use with rifles of the type having a cartridge casing ejection port in connection with the exterior of the rifle, said cartridge casing collector comprising:

a housing member having a collecting chamber formed therein in communication with a casing receiving aperture, said housing member including a first housing section having a second aperture, and a second housing section, hingedly secured to said first housing section in a manner such that said second housing section blocks passage of cartridge casings through said second aperture when in a first predetermined position and is moveable into a second predetermined position such that cartridge casings my pass through said second aperture; and a spring loaded gripping assembly, secured to said housing member, for securing said casing receiving aperture over said ejection port of said rifle in a manner such that cartridge casings ejected from said ejection port are directed through said cartridge casing receiving aperture and into said collecting chamber;

said collecting chamber being at least partially defined by an interior surface having a radius of curvature between three and one-eight (3-⅛") and five and one-half (5-½") inches and a length corresponding to an arc of at least thirty (30°) degrees of said radius of curvature;

said gripping assembly including a clamp member including a recessed portion along an edge thereof and a rod member, extending therefrom, having a threaded end section and a guide channel formed along a length thereof that is sized to slidingly receive a guide tab extending into a clamp guide. bore.

6. The cartridge casing collector of claim 3 wherein:

a portion of a collector outer surface of said housing member that is positioned adjacent a rifle outer surface of said rifle during use is defined by a radius of between three-quarters (¾") and two and one-half (2-½") inches moved through a first arc sufficient to provided an access gap between said rifle outer surface of said rifle and said collector outer surface of said housing member sufficient to allow a thumb of a user to be disposed therebetween.

7. The cartridge casing collector of claim 5 wherein:

a portion of a collector outer surface of said housing member that is positioned adjacent a rifle outer surface of said rifle during use is defined by a radius of between three-quarters (¾") and two and one-half (2-½") inches moved through a first arc sufficient to provided an access gap between said rifle outer surface of said rifle and said collector outer surface of said housing member sufficient to allow a thumb of a user to be disposed therebetween.

* * * * *